United States Patent [19]

Picchietti, Sr. et al.

[11] Patent Number: 4,937,911

[45] Date of Patent: Jul. 3, 1990

[54] BOWLING ALLEY LANE CLEANING APPARATUS

[76] Inventors: Remo Picchietti, Sr., 1600 Audubon La., Bannockburn, Ill. 60015; Thomas A. Westenberger, 4313 Lake St., Burlington, Wis. 53105

[21] Appl. No.: 202,104

[22] Filed: Jun. 3, 1988

[51] Int. Cl.[5] ..... A47L 9/00

[52] U.S. Cl. ..... 15/320; 15/319; 15/340.2

[58] Field of Search ..... 15/320, 321, 340.2, 15/319, 339, 340.1; 180/79, 203, 7.2, 199

[56] References Cited

U.S. PATENT DOCUMENTS

| | | | |
|---|---|---|---|
| 3,559,230 | 2/1971 | Ogle | 15/320 X |
| 3,942,214 | 3/1976 | Maasberg | 15/320 |
| 4,023,233 | 5/1977 | Prestwich | 15/320 |

OTHER PUBLICATIONS

EP 0286,328 Oct./1988 Korski.

*Primary Examiner*—Frankie L. Stinson

*Attorney, Agent, or Firm*—Neuman, Williams, Anderson & Olson

[57] ABSTRACT

Apparatus movable over an approach surface and down a lane surface includes a shield plate which has a forward edge positionable to prevent cleaning fluid from nozzles from reaching the approach surface behind a foul line while permitting cleaning of the lane surface beyond the foul line. A pair of forward wheels are used for support during movement over the approach surface and are arranged to drop down into side gutters to engage support rollers with the lane surface and to also drop a fluid pick-up head into engagement with the approach surface at the foul line.

13 Claims, 2 Drawing Sheets

BOWLING ALLEY LANE CLEANING APPARATUS

BACKGROUND OF THE INVENTION

1. Field of the Invention

This invention relates to apparatus for cleaning lanes of bowling alleys and more particularly to apparatus which is readily operable and with which the surfaces of lanes are quickly and efficiently cleaned without adverse effects on approach surfaces. The apparatus of the invention uses commercially available vacuum cleaning equipment and is economically manufacturable while being highly reliable and trouble-free in operation.

2. Background of the Prior Art

Various types of machines have heretofore been used or proposed for avoiding the expense and problems with manual cleaning operations. One type of machine uses a nozzle to apply a cleaning fluid to a lane surface and vacuum apparatus to pick up the applied fluid. For example, in one machine of this type, a fluid-applying nozzle and vacuum pick-up apparatus are carried by a frame which is supported by one set of wheels for movement down a lane surface and by another set of wheels for movement to and from the lane surface, the latter set of wheels including front caster wheels which drop into gutters on opposite sides of the lane surface. A pick-up head is provided to remove cleaning fluid applied by a nozzle, ahead of the machine. The pick-up head includes a flexible skirt around the perimeter of a pick-up area, the skirt having ribs on its outer surface and being operative to provide a leading lip which bends to provide openings between ends of the ribs and to provide a trailing lip which maintains continuous contact. This type of machine has advantages over manual cleaning operations and is potentially capable of producing very clean lane surfaces, but prior machines of this type have been relatively expensive in construction, have not been easy to operate and have not been as reliable and as durable or would be desirable.

SUMMARY OF THE INVENTION

This invention was evolved with the general object of providing apparatus which applies and automatically picks up cleaning fluid and which is easy to operate and with which the surfaces of lanes are quickly, efficiently and uniformly cleaned while being economically manufacturable reliable and trouble-free in operation.

An important aspect of the invention relates to the discovery and recognition of problems and deficiencies with respect to machines as previously proposed. It is found that particularly important problem areas are the portions of lane and approach surfaces which are adjacent the foul line which is at the junction between such coplanar surfaces. The portion of the lane surface which is closest to the foul line is that which is initially engaged by the ball and can have a quite significant effect on the path followed by the ball and should therefore have characteristics which are as uniform as possible. It is also the portion of the lane surface with is subjected to the most abuse from engagement by the balls and which receives a substantial amount of oil and other lubricating or foreign matter carried from the approach surface and beyond the foul line by bowler's shoes or otherwise. It is found to be therefore important that the lane surface be thoroughly and uniformly cleaned right up to the foul line. It is also found, however, that the cleaning should not extend to the approach surface and that adverse effects may result if it does. The approach surface must have characteristics such as to permit a certain degree of sliding action of the bowler's shoe, and the application of a detergent cleaning solution to the approach surface can act to destroy the desired characteristics of the approach surface and interfere with the bowler's delivery.

Important features of the invention relate to the provision of fluid-applying and suction pick-up devices which are constructed and arranged for preventing application of cleaning fluid to the approach surface behind the foul line while permitting application and removal of cleaning fluid to and from the lane surface ahead of the foul line. In apparatus of the invention, a shield plate which forms a fluid-intercepting wall means is supported on a support frame of the apparatus and has a forward edge extending transversely across the lane surface, the shield plate being effective to intercept fluid and prevent fluid from reaching portions of the lane surface positioned behind the forward edge of the shield plate.

The shield plate is particularly desirable when operating with one or more nozzles which are inherently incapable of producing a fluid distribution pattern with a sharply defined boundary. In particular, the fluid distribution pattern of the nozzles may include a primary region extending across the lane and having a relatively high fluid density and a marginal region behind the primary region and having a density which gradually tapers off from that of the primary region. The forward edge of the shield plate is so positioned relative to such primary and marginal regions as to provide a sharply defined boundary extending across the lane surface and to insure that adequate fluid will reach portions of the lane surface which are positioned forwardly from the sharply defined boundary while preventing fluid from reaching portions of the lane surface which are positioned behind the sharply defined boundary and while also limiting the volume of fluid intercepted by the shield plate.

Further features of the invention relate to the support of the apparatus during movement over approach surfaces before and after cleaning of a lane surface and to the support and guidance of the apparatus during the cleaning of a lane surface. Wheels which support the apparatus during movement over the approach surface include two front wheels which are spaced and positioned to drop down into gutters on opposite sides of the lane surface and to transfer support to a pair of wheels or rollers which engage the lane surface. At the same time, the pick-up head is brought down into operative position, to pick-up fluid applied to the lane surface in front of the foul line. In addition guide wheels or rollers are provided to engage the sides of the gutters adjacent the lane surface and to limit transverse movement of the apparatus. Four support wheels or rollers and four guide wheels or rollers are preferably provided with each support roller having a diameter which is somewhat smaller than an associated guide roller and both being journaled on a common axis.

A further feature relates to the provision of spring means acting on each guide roller to urge it into engagement with the gutter surface and to accommodate lane surfaces of different widths, while enhancing the guidance functions thereof.

Additional features relate to the construction of the pick-up head in a manner such as to obtain uniform and efficient action and reliable and trouble-free operation.

This invention contemplates other objects, features and advantages which will become more fully apparent from the following detailed description taken in conjunction with the accompanying drawings.

DESCRIPTION OF A PREFERRED EMBODIMENT

Figure 1:
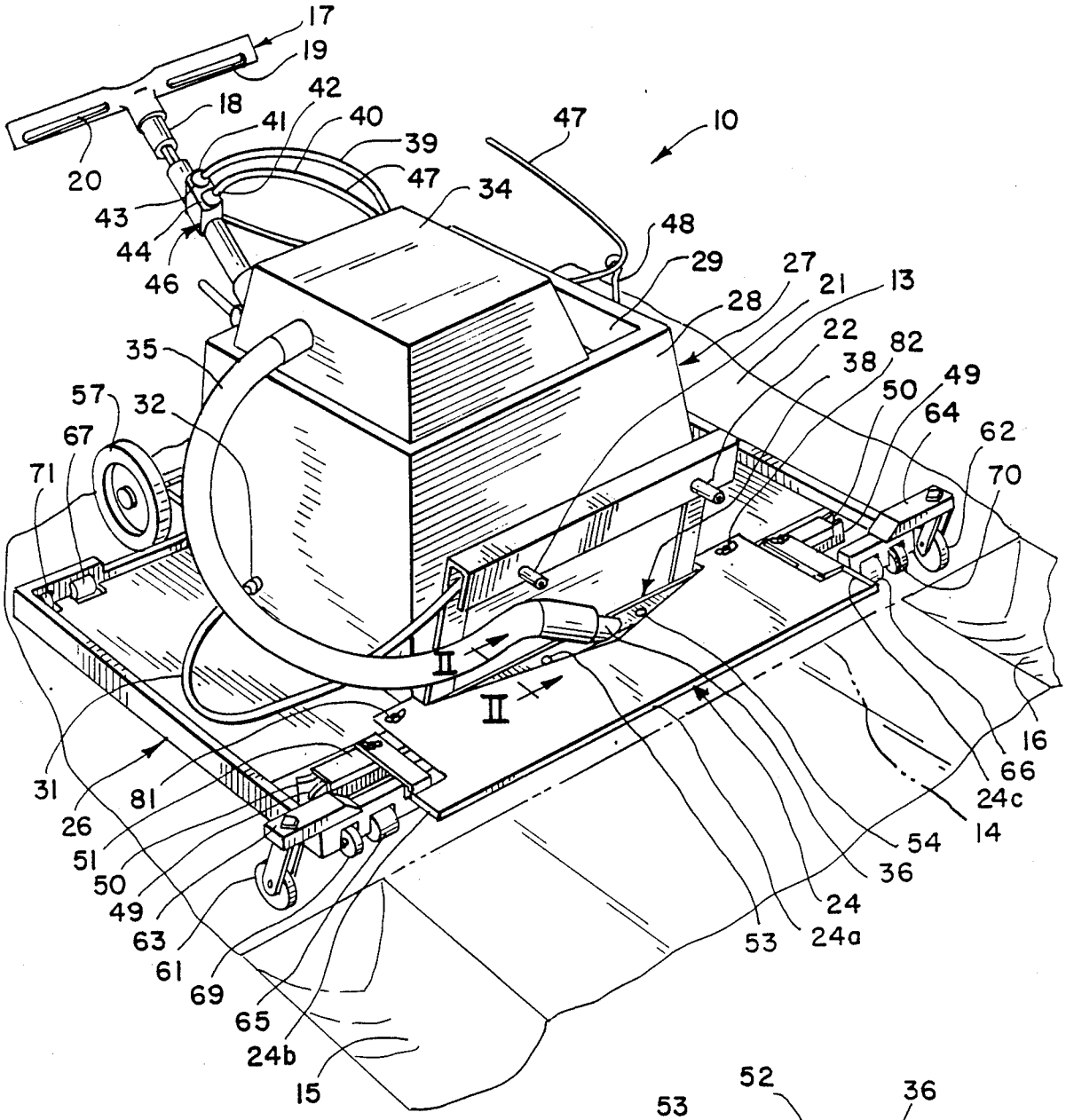
FIG. 1 is a perspective view showing lane cleaning apparatus of the invention positioned on an approach surface and ready to clean a lane surface.

Reference numeral 10 generally designates bowling lane cleaning apparatus constructed in accordance with the principles of this invention, usable for cleaning a bowling lane surface 12. As shown, one end of the lane surface 12 is contiguous to a coplanar approach surface 13 along a foul line which is indicated by a broken line 14. A pair of side gutters 15 and 16 extend from the approach surface 13 and the foul line 14 to the opposite end of the lane at Which the pins are set. As aforementioned, it is found to be very important that the lane surface be uniformly cleaned, starting at the foul line, while avoiding any cleaning of the approach surface 13, which should be such as to permit a bowler's shoe to slide thereon during his or her approach.

The apparatus includes a handle 17 at the end of a column 18 which is shown with an intermediate portion broken away but which has a length such as to position the handle 17 at height which is convenient for engagement by the hands of a standing operator. The handle 17 carries two manually actuatable control levers 19 and 20. Control lever 19 is operative to control the application of a cleaning fluid. Control lever 20 is operative to control operation of vacuum apparatus for picking up applied cleaning fluid. The operator of the apparatus 10 grasps the handle 17 and moves the apparatus to a position as illustrated in FIG. 1 and then actuates the control lever 19 to cause cleaning fluid to be projected from two nozzles 21 and 22 onto the lane surface 12, beginning at the foul line 14. At the same time, or shortly after actuating the lever 19, the operator actuates the control lever 20 to activate the vacuum pick-apparatus. Then, while actuating both levers 19 and 20, the operator pushes the apparatus in a forward direction down the lane, moving at a slow walking speed. Then the operator pulls the apparatus back along the lane surface 12 to return to the approach surface 13. During the return movement, only the pick-up control lever 20 may be actuated.

A very important feature relates to the provision of means for insuring that fluid is applied to the lane surface 12, starting at the foul line 14, while preventing application of fluid to the approach surface 13. In the apparatus as illustrated, a fluid intercepting wall is formed by a shield plate 24 which has a straight transversely extending forward edge **24*a*, located below the nozzles 21 and 22 and positioned at the margin of the fluid distribution pattern thereof. Before actuating the fluid control lever 19, the apparatus is positioned as shown with the edge 24*a* positioned in accurate alignment between the nozzles 21 and 22 and the foul line 14. Then when the lever 19 is actuated, fluid will be applied to the lane surface 12 extending forwardly from the foul line 14 but will not be applied to the approach surface 13**.

As shown, the forward edge **24*a* of shield plate 24 is in the form of an up-turned lip and a pair of up-turned lips 24*b* and 24*c* may also be provided on the shield 24 for retention of fluid impinging on the plate 24. Preferably, a layer of a fluid absorbing material, such as a towel, is laid on top of the shield 24 during operation of the apparatus, to further insure that fluid will be so retained as not to reach the approach surface 13**.

Additional important features of the invention relate to control of removal of cleaning fluid from the surface 12, to supporting and guiding of the apparatus during its movement onto and down the lane surface 12 and to constructions such as to facilitate use of the apparatus and obtain reliable and trouble-free operation thereof.

The illustrated apparatus 10 includes a frame 26 which is arranged to support a conventional industrial type of cleaning unit 27. Unit 27 includes a housing 28 which has opening 29 at the upper end of a cleaning fluid tank therewithin and also includes a conventional electric motor-driven fluid supply pump for pumping the fluid from the fluid tank to an outlet which is connected to one end of a fluid supply hose 31 through a conventional detachable fluid coupler 32, the other end of hose 31 being connected to the nozzles 21 and 22. In addition, the unit 27 includes a vacuum chamber having a removable top cover 34 which is coupled through a vacuum hose 35 to a fitting 36 on the upper side of a fluid pick-up head 38. An electric motor-driven vacuum pump is provided within the unit 27 for drawing fluid into the chamber below the top cover 34 with only the liquid portion of the fluid being retained in the chamber. It will be understood that the unit 27 may be any standard commercially available type of unit and details of its construction are not shown.

The electric drive motors for the fluid supply and vacuum pumps of unit 27 are connected to line cords 39 and 40 which are connectable through plugs 41 and 42 to receptacles 43 and 44 in a box 46 which mounted on the column 18. Receptacles 43 and 44 are connected to a line cord 47 through wires within the support 18 and through switches controlled by levers 19 and 20. Preferably, the plugs 41 and 42 have different colors and the receptacles 43 and 44 have matching colors to facilitate making of the proper connections. An upstanding guide 48 is provided on one side of the frame 26 for receiving the line cord 47 and keeping it in the gutter 16 along one side of the lane as the apparatus is moved therealong.

Figure 2:
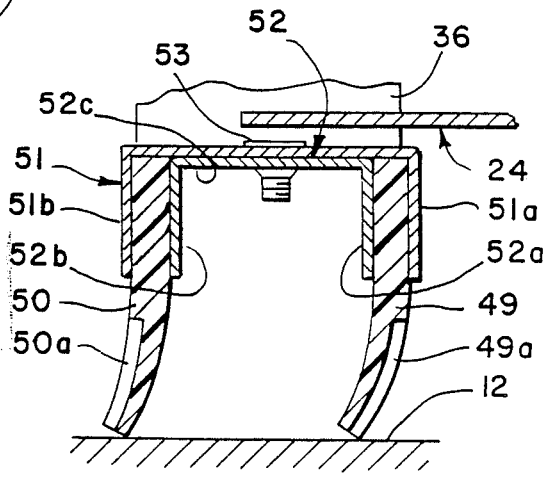
FIG. 2 is a cross-sectional view on an enlarged scale taken substantially along line II—II of FIG. 1 and showing the construction of a pick-up head.

The fluid pick-up head 38 comprises forward and rearward blades 49 and 50 of resilient elastomeric material and outer and inner support members 51 and 52 for support of the blades 49 and 50. As shown in the cross-sectional view of FIG. 2, each of the outer and inner support members 51 and 52 has a cross-sectional configuration of generally inverted U-shaped form. An upper edge portion of the forward blade 49 is sandwiched between depending side walls **51*a* and 52*a* of the outer and inner support members 51 and 52. Similarly, an upper edge portion of the rearward blade 50 is sandwiched between depending rearward side walls 51b and 52b of the outer and inner support members 51 and 52. The fitting 36 is welded or otherwise secured to an upper wall 51c of the outer member 51 over a central opening therethrough which is aligned with a central opening in an upper wall 52c of the inner support member 52 to establish vacuum communication with the space between the blades 49 and 50. Screws 53 and 54 (FIG. 1) have shank portions which extend through openings in the upper wall 51c of the outer member 51 and which are threaded into the upper wall 52c of the inner member 52 to secure the members together after installation of the blades 49 and 50, the screws 53 and 54** being removable for replacement of worn blades, if and when necessary.

A series of vertical grooves 49a and 50a are provided in lower portions of the forward and rearward surfaces of the forward and rearward blades 49 and 50, to provide a ribbed configuration. During forward movement, the blades 49 and 50 bend in a trailing manner as shown. The trailing rearward blade 50 is in continuous contact with the lane surface 12, the grooves 50a being in the rearward surface of blade 50. However, the grooves 49a of the leading blade 49 provide openings between the lane surface 12 and the lower edges of the forward blade 49 so as to permit flow of air and relative movement of fluid from the region in front of the forward blade 49 and into the space between the blades 49 and 50. Air may also enter through the opposite ends of the pick-up head 38, which are open, to flow into the space between the blades 49 and 50 and to flow out through the centrally located fitting 36 and into the vacuum hose 35, along with air and cleaning fluid which have entered through the openings provided by the grooves 49a. The sizes and relationship of the end openings and the openings provided by the grooves 49a are such as to obtain a substantial vacuum pressure over the full transverse extent of the pick-up head to effect removal of fluid from the full width of the lane surface 12. As a result, substantially all of the fluid which passes under the forward blade 49 and into the space between the blades 49 and 50 is withdrawn and the quantity of fluid which is left on the lane surface is very small. That which is left quickly evaporates.

It is not generally necessary to do so, but vacuum pressure may be maintained during return movement of the apparatus back to the approach surface 13, by operation of the control lever 20. During the return movement, the blades 49 and 50 trail in the opposite direction and their actions are reversed. Any fluid which might be on the lane surface 12 during the return movement may then enter the space between the blades 49 and 50, through openings at the lower ends of the grooves 50a which is the leading blade during the return movement.

Figure 3:
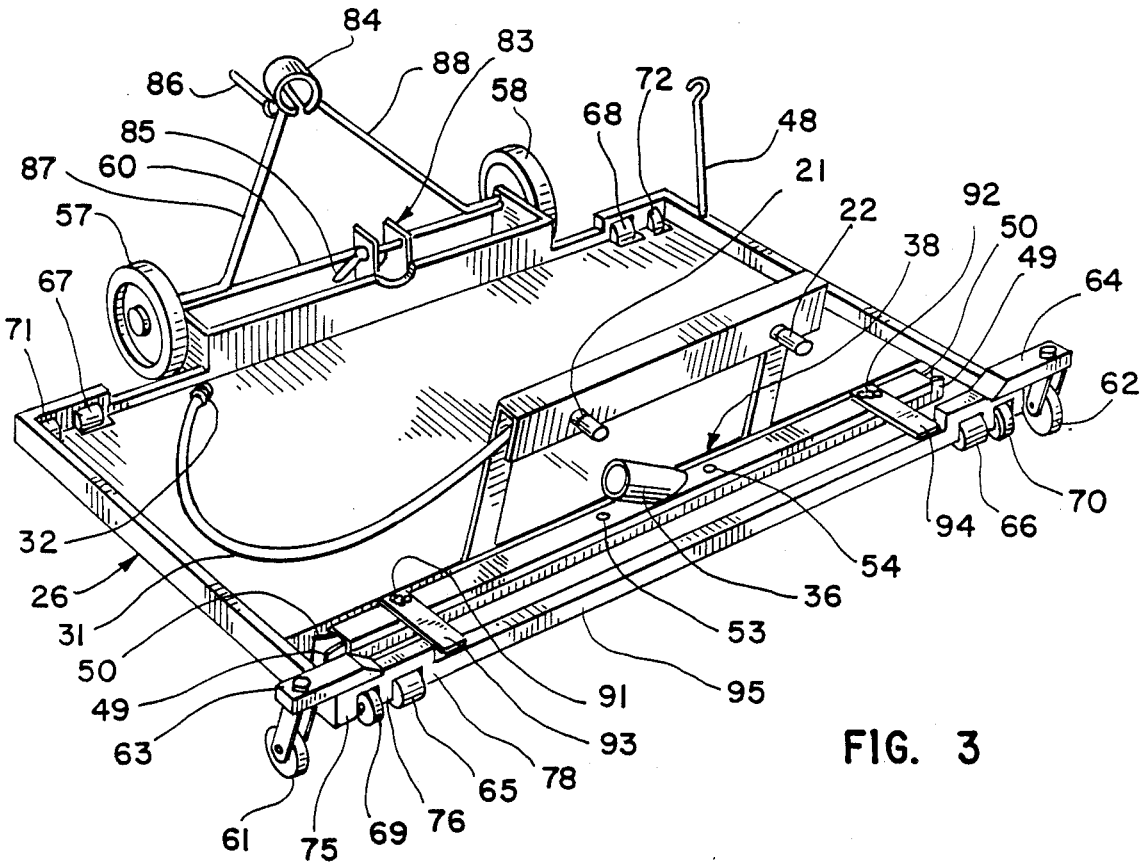
FIG. 3 is a perspective view similar to FIG. 1 but showing the apparatus prior to assembly of a fluid applying and vacuum unit and other components thereon.

The unit 27 can be separately stored or transported and is readily installed on the frame 26 and removed therefrom, as desired, the fluid supply and vacuum lines 31 and 35 and electrical line cords 39 being readily connected and disconnected. The frame 26 and associated parts of the apparatus are also arranged for compact storage and transport and for ready assembly. FIG. 3 shows the frame 26 before installation of the shield plate 24, the handle 17 and handle support 18 and the unit 27. It also more clearly shows the fluid pick-up head 38, the support of the frame 26 and other important details of construction.

For support of the frame 26 during movement over the approach surface 13, two rear wheels 57 and 58 are journaled on the ends of an axle 60 and two forward caster wheels 61 and 62 are swivelly mounted under support members 63 and 64 which extend outwardly from forward corner portions of the frame 26. As the apparatus is moved forwardly beyond the foul line 14, the caster wheels drop into the gutters 15 and 16 and with continued forward movement, support and guidance of the frame is transferred to small diameter wheels or rollers journaled on the frame 26.

In particular, a pair of forward support rollers 65 and 66 and a pair of rearward support rollers 67 and 68 are provided, the rollers of each pair of support rollers having a transverse spacing somewhat less than the width of the lane surface. In addition, a pair of forward guide rollers 69 and 70 and a pair of rearward guide rollers 71 and 72 are provided, the rollers of each pair of guide rollers having a transverse spacing greater than the width of the lane surface and being on the outside of the associated support rollers. The undersides of the guide rollers 69–72 are below the undersides of the undersides of the corresponding support rollers 65–68 so that when the apparatus is supported by the support rollers 65–68 on the 25 lane surface 12, inside surface portions of the guide roller 69–72 may engage side portions of the surfaces of gutters 15 and 16 which are adjacent the lane surface 12 to limit transverse displacement of the apparatus and thereby guide the apparatus during movement over the lane surface 12.

Figure 4:
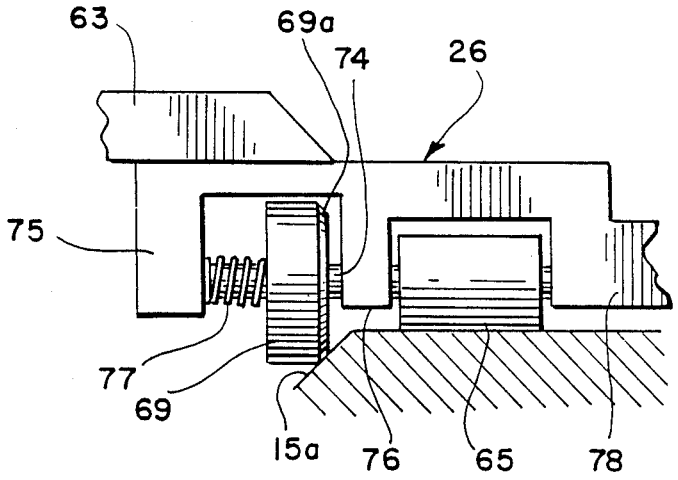
FIG. 4 is an elevational view of a portion of the apparatus, showing one support roller and an associated guide roller.

Preferably, each of the guide rollers 69–72 is journaled on the same axis as the associated one of the support rollers 65–68 and each of the guide rollers 69–72 has a diameter somewhat greater than that of the associated one of the support rollers 65–68. Another feature relates to the provision of spring means acting on each of the guide rollers 69–72 to urge it inwardly, facilitating the guidance function thereof and more readily accommodating variations in the width of the lane surface 12. As shown in FIG. 4, the guide roller 69 is journaled on a shaft 74 between downwardly extending portions 75 and 76 of the frame 26 and a coiled compression spring 77 is disposed about the shaft 74 between the frame portion 75 and the outer side of the guide roller 69 to urge the guide roller 69 inwardly and to effect engagement between a beveled surface portion 69a of the roller 69 and a surface portion 15a of the gutter 15 adjacent the lane surface 12. As also shown, the support roller 65 is also journaled on the shaft 74 between the frame portion 74 and another frame portion 78. The guide and support rollers of each of the other sets are supported and arranged in a similar manner, with a spring acting on each of the other guide rollers 69–72 to urge it inwardly.

As shown, the pick-up head 38 is positioned behind the forward caster wheels 61 and 62. When the caster wheels 61 and 62 drop down into the gutters 15 and 16, the blades 49 and 50 of the pick-up head are brought down into engagement with the approach surface 13 at or slightly behind the foul line 14 to be ready to pick-up fluid applied to the lane surface 12 at the foul line 14 and therebeyond.

As aforementioned, the unit 27 can be separately stored or transported and is readily installed on the frame 26 and removed therefrom, as desired, and the frame 26 and associated parts of the apparatus are also arranged for compact storage and transport and for ready assembly. The shield plate 24 is removable, being held in place by a pair of wing nuts 81 and 82. The handle 17 and its supporting column 18 are also removably connected to the frame 26. Two clamp devices 83 and 84 are provided which are operated by handles 85 and 86, the clamp device 83 being supported on the frame 26 and the clamp device 84 being supported from the axle 60 through a pair of arms 87 and 88. In assembly, a lower end portion of the column 18 is inserted through the clamp device 84 and a lower terminal end of the column is inserted into the clamp device 83 on the frame 26, the handle 85 being then operated to lock the terminal end of the column 18 to the frame 26. Then the angular position of the column 18 about the axis of the shaft 60 may be adjusted until the handle 17 is at the desired height, after which locking device 84 is operated by handle 86 to fix the position of the handle 17 and column 18 relative to the frame 26.

It is also noted that the pick-up head 38 is removably connected through wing nuts 91 and 92 to a pair of arms 93 and 94 which have forward ends welded or otherwise rigidly secured to a forward transversely extending portion 95 of the frame 26.

It will be understood that modifications and variations may be effected without departing from the spirit and scope of the novel concepts of this invention.

We claim:

1. Apparatus for cleaning a bowling alley lane, wherein one end of a lane surface and a coplanar approach surface are contiguous along a foul line and wherein a pair of gutters extend along opposite sides of said lane surface from said approach surface to the opposite end of said lane surface, said apparatus comprising: a frame structure, roller means for supporting said frame structure for movement in a forward direction over said approach surface and along said lane surface to said opposite end thereof and then in a rearward direction back to said approach surface, fluid-applying means on said frame structure for applying a cleaning fluid onto said lane surface, and suction means supported from said frame structure and including pick-up head means extending across the full width of said lane surface to remove cleaning fluid applied by said fluid-applying means, said fluid-applying means and said suction means being constructed and arranged for preventing application of cleaning fluid to said approach surface behind said foul line while permitting application and removal of cleaning fluid to and from said lane surface ahead of said foul line, wherein said fluid-applying means includes fluid-intercepting wall means supported on said frame structure and having a forward edge extending transversely across said lane surface, said wall means being effective to intercept fluid and prevent fluid from reaching portions of said lane surface positioned behind said forward edge of said wall means, and said forward edge forming a forward-most edge portion of said apparatus and being positioned for view by an operator of said apparatus to facilitate accurate positioning of said forward edge relative to said foul line.

2. Apparatus for cleaning a bowling alley lane as defined in claim 1, wherein said fluid-applying means includes nozzle means spaced upwardly from said wall means and behind said forward edge thereof and arranged for projecting fluid forwardly beyond said forward edge onto said lane surface.

3. Apparatus for cleaning a bowling alley lane as defined in claim 2, wherein said wall means includes a generally horizontal plate extending forwardly from said frame structure and detachably secured thereto.

4. Apparatus for cleaning a bowling alley lane, wherein one end of a lane surface and a coplanar approach surface are contiguous along a foul line and wherein a pair of gutters extend along opposite sides of said lane surface from said approach surface to the opposite end of said lane surface, said apparatus comprising: a frame structure, roller means for supporting said frame structure for movement in a forward direction over said approach surface and along said lane surface to said opposite end thereof and then in a rearward direction back to said approach surface, fluid-applying means on said frame structure for applying a cleaning fluid onto said lane surface, and suction means supported from said frame structure and including pick-up head means extending across the full width of said lane surface to remove cleaning fluid applied by said fluid-applying means, said fluid-applying means and said suction means being constructed and arranged for preventing application of cleaning fluid to said approach surface behind said foul line while permitting application and removal of cleaning fluid to and from said lane surface ahead of said foul line, wherein said fluid-applying means includes fluid-intercepting wall means supported on said frame structure and having a forward edge extending transversely across said lane surface, said wall means being effective to intercept fluid and prevent fluid from reaching portions of said lane surface positioned behind said forward edge of said wall means, wherein said fluid-applying means includes nozzle means having a fluid distribution pattern which is such as to include a primary region extending across said lane and having a relatively high fluid density and a marginal region behind said primary region and having a density which gradually tapers off from that of said primary region, said forward edge of said wall means being so positioned relative to said primary and marginal regions as to insure that adequate fluid will reach portions of said lane surface which are positioned forwardly from said forward edge while preventing fluid from reaching portions of said lane surface which are positioned behind said forward edge and while also limiting the volume of fluid intercepted by said wall means.

5. Apparatus for cleaning a bowling alley lane wherein one end of a lane surface and a coplanar approach surface are contiguous along foul line and wherein a pair of gutters extend along opposite sides of said lane surface from said approach surface to the opposite end of said lane surface, said apparatus comprising: a frame structure, roller means for supporting said frame structure for movement in a forward direction over said approach surface and along said lane surface to said opposite end thereof and then in a rearward direction back to said approach surface, fluid-applying means on said frame structure for applying a cleaning fluid onto said lane surface, and suction means supported from said frame structure and including pick-up head means extending across the full width of said lane surface to remove cleaning fluid applied by said fluid-applying means, said roller means comprising support rollers journaled on said frame structure and arranged for supporting engagement with said lane surface, and guide rollers journaled on said frame structure and arranged for engagement with surface portions of said gutters adjacent opposite sides of said lane surface to limit transverse movement of said apparatus during longitudinal movement over said lane surface.

6. Apparatus for cleaning a bowling alley lane as defined in claim 5, wherein said roller means further comprise wheels journaled on said frame structure and arranged for supporting engagement with said approach surface, said wheels including pair of forward wheels arranged to drop down into said gutters and to drop said support rollers into engagement with said lane surface.

7. Apparatus for cleaning a bowling alley lane as defined in claim 6, wherein said pair of forward wheels are so positioned in forwardly spaced relation to said pick-up head means as to drop said pick-up head means into engagement with said approach surface behind said foul line when said pair of forward wheels drop into said gutters.

8. Apparatus for cleaning a bowling alley lane as defined in claim 7, wherein said fluid-applying means and said suction means are constructed and arranged for preventing application of cleaning fluid to said approach surface behind said foul line while permitting application and removal of cleaning fluid to and from said lane surface ahead of said foul line.

9. Apparatus for cleaning a bowling alley lane surface wherein a coplanar approach surface and one end of said lane surface meet at a foul line and wherein a pair of gutters extend along opposite sides of said lane surface from said approach surface to the opposite end of said lane surface, said apparatus comprising: a frame structure, roller means for supporting said frame structure for movement in a forward direction over said approach surface and along said lane surface to said opposite end thereof and then in a rearward direction back to said approach surface, fluid-applying means on said frame structure for applying a cleaning fluid onto said lane surface, and suction means supported from said frame structure and including pick-up head means extending across the full width of said lane surface to remove cleaning fluid applied by said fluid-applying means, said pick-up head means comprising forward and rearward blade members of resilient material for extending across said lane surface and outer and inner support members for supporting said blade members, said support members having cross-sectional configurations of generally inverted U-shaped form, each including a pair of forward and rearward side walls extending downwardly from forward and rearward edges of a horizontal wall, said forward blade member having an upper portion clamped between said forward walls of said inner and outer support members and said rearward blade member having an upper portion clamped between said rearward side walls of said inner and outer support members.

10. Apparatus for cleaning a bowling alley lane as defined in claim 9, wherein a lower edge portion of the forward surface of said forward blade member which extends from one end of said forward blade member to the other is formed with transversely spaced grooves which provide spaces for passage of fluid from the space ahead of said forward blade member and into the space between said blade members during movement in said forward direction.

11. Apparatus for cleaning a bowling alley lane as defined in claim 10, wherein a lower edge portion of the forward surface of said rearward blade member is continuous from one end of said rearward blade member to the other to limit movement of fluid from the space between said blade members to the space behind said rearward blade member during movement in said forward direction.

12. Apparatus for cleaning a bowling alley lane as defined in claim 12, wherein a lower edge portion of the rearward surface of said rearward blade member which extends from one end of said rearward blade member to the other is formed with transversely spaced grooves which provide spaces for passage of fluid from the space ahead of said rearward blade member and into the space between said blade members during movement in said rearward direction.

13. Apparatus for cleaning a bowling alley lane as defined in claim 12, wherein a lower edge portion of the rearward surface of said forward blade member is continuous from one end of said forward blade member to the other to limit movement of fluid from the space between said blade members to the space behind said forward blade member during movement in said rearward direction.

* * * * *